United States Patent [19]

Bianchi et al.

[11] 4,346,827

[45] Aug. 31, 1982

[54] VESTLIKE WEAPON CARRIER

[75] Inventors: John E. Bianchi; Richard D. E. Nichols, both of Fallbrook, Calif.

[73] Assignee: Bianchi Leather Products, Inc., Temecula, Calif.

[21] Appl. No.: 213,382

[22] Filed: Dec. 5, 1980

[51] Int. Cl.[3] ..... A41D 1/04; F41C 33/00

[52] U.S. Cl. ..... 224/206; 224/209; 224/243; 224/911

[58] Field of Search ..... 224/206, 215, 243, 244, 224/911, 209; D22/13

[56] References Cited

U.S. PATENT DOCUMENTS

| | | | |
|---|---|---|---|
| D. 214,560 | 7/1969 | Kassel | 224/911 |
| D. 234,840 | 4/1975 | Adams | 224/911 |
| 1,797,359 | 3/1931 | Meyers | 224/206 X |
| 2,396,118 | 3/1946 | Ohlemeyer | 224/911 |
| 2,579,782 | 12/1951 | Booth | 224/206 |
| 4,068,784 | 1/1978 | Angell | 224/206 |
| 4,262,832 | 4/1981 | Perkins | 224/206 |

*Primary Examiner*—William Price
*Assistant Examiner*—Gary E. Elkins
*Attorney, Agent, or Firm*—Wagner & Bachand

[57] ABSTRACT

An improved vestlike weapon carrier providing concealed and comfortable carrying of a handgun by a plain clothes law enforcement officer. The handgun is supported under one arm and an ammunition pouch under the other. The handgun is held in a holster having a thumb release retainer strap and a body which is formed to match the contour of the frame and barrel of the handgun. The handgun is supported with the barrel muzzle slightly elevated for natural action cross-drawing by the officer. The holster is supported by a crescent shaped shoulder strap and a pair of "D" rings secured to the holster at the muzzle region and the chamber region of the handgun for balanced carriage. A similar crescent shaped shoulder strap supports a generally "Y" shaped ammunition or clip carrier. The shoulder straps are joined by elastic straps extending across the back of the wearer. No straps extend across the chest of the wearer. The elastic straps and the intermediate sections of the crescent shaped shoulder straps define a flexible quadrilateral biased against the wearer's back and distortable upon movement of the wearer to maintain the holster and handgun in a stable position.

5 Claims, 10 Drawing Figures

FIG. 7
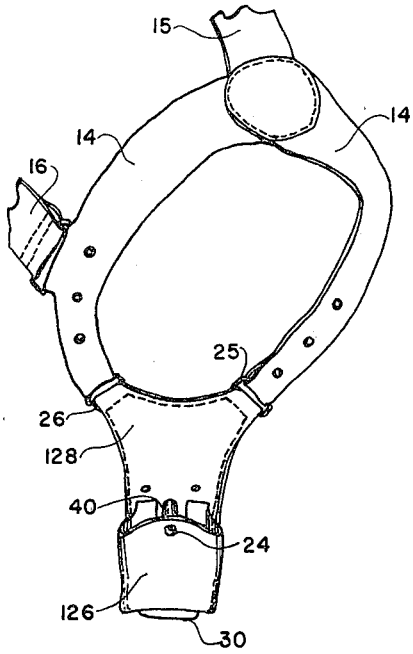
FIG. 8
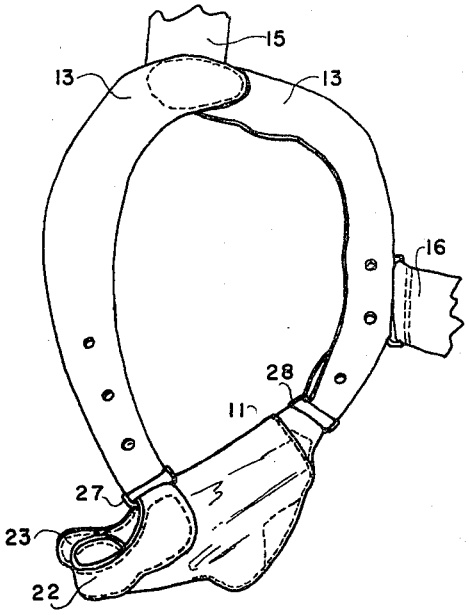
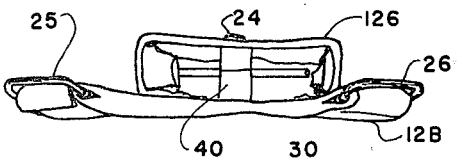
FIG. 9
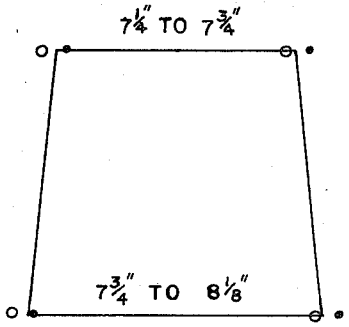
FIG. 10

VESTLIKE WEAPON CARRIER

BACKGROUND OF THE INVENTION

Concealable underarm holsters have been available to law enforcement officers for many years. Typically they have employed a single shoulder strap carrying a holster under one arm. A horizontal strap extending around the wearer's back, around his opposite shoulder and return across his back. This type of holster has reasonably held the holster in place, primarily due to the tension on the horizontal strap. It offers a major disadvantage, however, by exterting a constant backward pressure on the officer's shoulders and on his underarm which is uncomfortable but has become accepted.

A recent development has been the vest-type holster which is in fact patterned after a man's vest fully open in front and distributing the weight of the handgun across the top of the shoulders with minimum transverse pressure. A holster is secured under the arm and certain of these holsters carry an ammunition pouch or clip holder under the opposite arm to balance the weight. These vestlike harnesses sometime use shoulder straps of the type used in the above described older underarm holsters and an adjustable strap across the back. Typical is the vestlike carrier disclosed in U.S. Design Pat. No. D234,840.

It has been found that such harnesses do not prevent the holster and handgun from moving and in fact swinging, pendulum fashion when an officer runs. Such action is undesirable, giving the officer concern for the security of his handgun and distracting him. Drawing a swinging handgun is not an easy accomplishment.

BRIEF STATEMENT OF THIS INVENTION

Faced with this state of the art we have analyzed the vestlike holsters, found the difficulties noted above and have determined the solution.

We have employed two crescent shaped shoulder straps which are shaped to conform with the wearer's shoulder line. The holster is secured by "D" rings to the ends of one shoulder strap. An ammunition clip or pouch is similarly secured to both ends of a "Y" shaped back. This integration of the holster and ammunition pouch into the loop formed with the shoulder strap adds stability to the assembly.

Additionally, we have found that overall stability of the entire rig is achieved when the two shoulder straps are joined by a pair of spaced broad elastic straps, one extending across the wearer's back just below the collar line and the second strap extending across the mid back region. The elastic straps provide a widely distributed contracting force both in the collar region and across the back. The two elastic straps and the shoulder straps define a quadrilateral of support and one which is distortable as the wearer moves, as in running. This capability allows the holster and pouch to move with the wearer as he twists his back, as occurs naturally while running. The wearer therefore does not move out from under the holster as occurred in prior art vestlike holsters.

BRIEF DESCRIPTION OF THE DRAWING

This invention may be more clearly understood from the following detailed description and by reference to the drawing in which:

FIG. 7 is a fragmentary right side elevational view of the clip carrier and right shoulder strap assembly of this invention;

FIG. 8 is a fragmentary left side elevational view of the holster;

FIG. 9 is a top plan view of the ammunition clip carrier of this invention; and FIG. 10 is a simplified graphical representation of the action of the harness of this invention during strenuous action of the wearer.

DETAILED DESCRIPTION OF THE INVENTION

Figure 1:
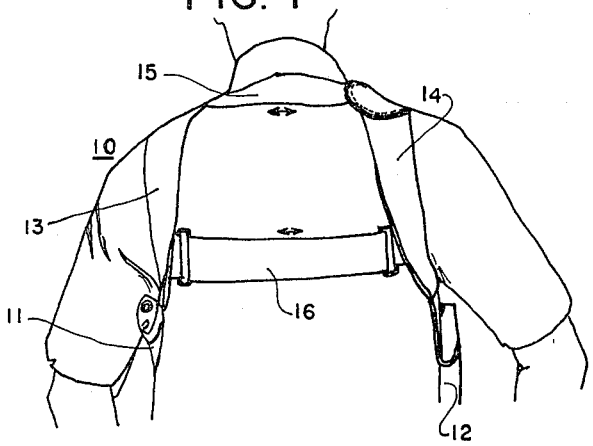
FIG. 1 is a rear view of the vestlike handgun carrier of this invention as worn.

This invention and its improvement is best illustrated in FIG. 1 which shows an officer wearing this invention viewed from the rear with his jacket removed and arms slightly extended to show how the harness 10 of this invention contours to the body and holds a holster 11 and clip pouch 12 close to the sides of the wearer.

The harness comprises basically of two shoulder straps 13 and 14 which are crescent shaped and contoured to the shoulder and arm regions of the wearer. The straps 13 and 14 are joined to the holster 11 and clip carrier by "D" rings best shown in FIGS. 3 and 4. The straps 13 and 14 are preferably of soft top grain leather and each stitched at the median region which extends over the top of the wearer's shoulder to distribute the load of the weapon and ammunition and to avoid any bulge visibility through the wearer's jacket at the shoulder line.

The most significant advance of this invention over the prior art is illustrated in FIG. 1. The two shoulder straps 13 and 14 are joined by a pair of elastic straps 15 and 16. The elastic strap 15 is preferably two inches wide and joins the straps at the shoulder of the wearer just below his collar line and actually bears some of the weight load since it rests in part on the slope of the upper back. This position is clearly illustrated in FIG. 1.

The lower elastic strap 16 joins the two shoulder straps lower on the wearer's back. The lower strap 16 is secured to the shoulder straps 13 and 14 by metal closed rectangular links sometimes called "D" rings.

Both straps 15 and 16 being elastic allow the wearer to walk, run or twist his shoulders in extreme movements allowing the movement to be matched by extension or contraction of the individual straps 15 or 16 independent of each other. The movement of these straps 15 or 16 maintains the shoulder straps 13 and 14 in fixed relationship with its respective shoulder without the tendency heretofore of the shoulder strap and holster to slip backward as the wearer's shoulder moves forward. This feature of the larger e.g. 1½ to 2 inch wide elastic straps 15 and 16 adds not only to the wearer's comfort but his peace of mind as the weapon follows his shoulder's movement and does not swing freely in a pendulum-like action.

Figure 2:
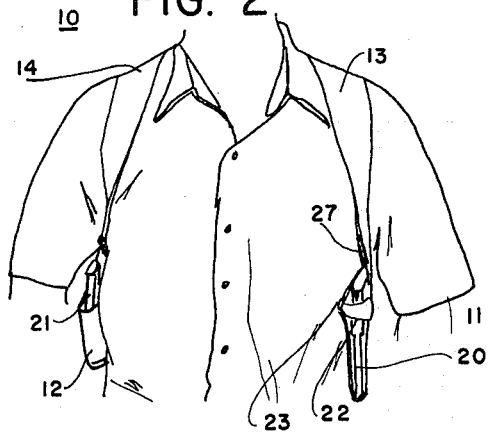
FIG. 2 is a front view thereof.

The normal position of the holster 11 and clip carrier 12 as viewed from the front with the officer's jacket removed, may be seen in FIG. 2. The handgun 20 is positioned with its grip facing forward and the barrel slightly elevated. This is better illustrated in FIG. 5. The handgun is retained in its holster 11 by a strap 22 which is an integral part of the outer face of the holster 11 and extends over the hammer region of the handgun 20 and is secured in place by a thumb tab 23. Preferably, the thumb tab 23 is metal reinforced to provide resistance to bending when the officer's thumb extends between the strap 22 and thumb tab 23 as illustrated in FIG. 6 in the act of drawing his weapon.

Figure 4:
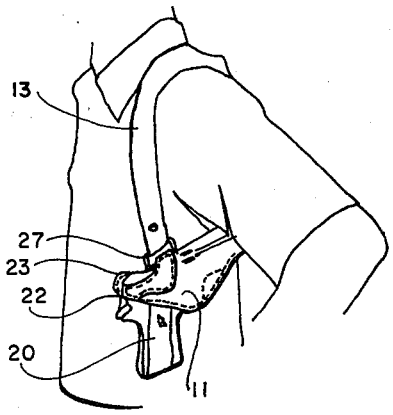
FIG. 4 is a left side elevational view thereof.
Figure 6:
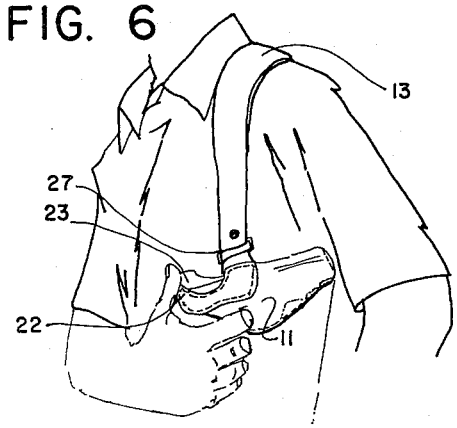
FIG. 6 is a left side view of an officer in the act of drawing an automatic handgun.

The holster 11 is secured to the crescent shaped shoulder strap 13 by a pair of "D" rings 27 and 28, only one of which appears in FIGS. 2, 4 and 6 and best seen in FIG. 8. The "D" rings 27 and 28, located at the chamber and muzzle regions of holster 11 respectively, define with the shoulder strap 13 a shoulder encircling shape which conforms closely to the shape of the shoulder and thus minimizes visibility of the assembly through the wearer's jacket.

Figure 3:
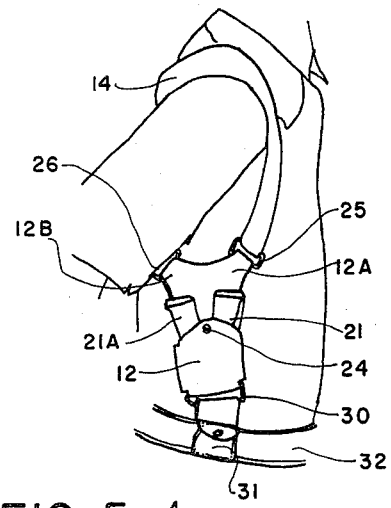
FIG. 3 is a right side elevational view thereof.

The ammunition or clip carrier 12 is seen from the side in FIG. 3. It is of generally Y shape including a pair of arms 12A and 12B connected by "D" rings 25 and 26 respectively, to the opposite ends of the crescent shaped shoulder strap 14. The leg of the carrier 12 is folded upward to define the front face of the clip pocket. A pair of clips 21 and 21A are shown in the carrier 12 separated by a screw fastener 24, better described in connection with FIGS. 7 and 9. The carrier is secured to the officer's belt 32 by a belt loop 31 which in turn engages a "D" ring 30 extending through the bottom loop of the pouch 12.

Figure 5:
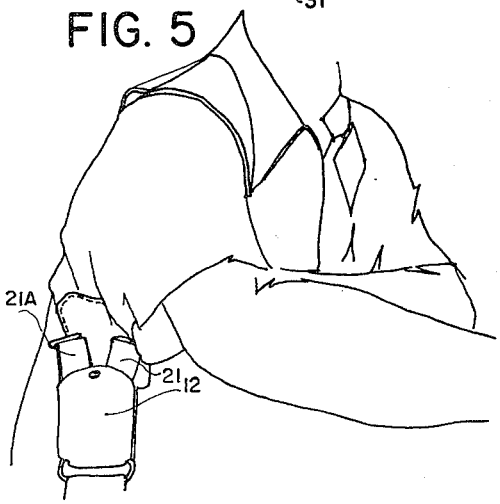
FIG. 5 is a right side view of an officer wearing the carrier of this invention and reaching for an ammunition clip.

The clips 21 and 21A are carried securely within the pouch 12 and available for removal upward as illustrated in FIG. 5. The upward motion used in removing the clips makes desirable the fastening of the carrier 12 to the wearer's belt.

Referring again to FIGS. 7 and 9, in which the adjustable friction arrangement of the clip carrier 12 of this invention may be more clearly seen. The pouch 12 is divided into two rectangular sections by the screw divider 24. This fastener is surrounded by a resilient washer or spacer 40 which protects the clips from abrasion by the screw fastener 24 and additionally cooperates with the leather body of the pouch to apply pressure on all four sides of each clip.

As the fastener 24 is tightened, it brings the front and rear faces of the pouch closer together thus adding to the frictional engagement of the faces with the flat sides of the clips. As the fastener 24 is tightened, the resilient washer 40 expands to counteract any widening of the pouch and to further apply edge pressure on the clips pressing each of them in opposite directions. The extent of tightening of the fastener 24 is up to the wearer and may be adjusted as the pouch "wears in". The officer may therefore be assured that his clip carrier will securely hold his extra clips and be removable with the degree of frictional resistance which he desires.

FIG. 10 shows in graphical form the effect of the quadrilateral arrangement of straps described above in connection with FIG. 1. The two horizontal members are extensible while the vertical members are not. If either shoulder is moved forward as in running, the quadrilateral is distorted by movement of the upper corners and, extension of the upper horizontal strap 15 and relative stability of the lower corners and lower strap 16. This accounts for the stability of the holster on one side and the clip carrier on the other. The belt loop 31 aids in the stability of the clip carrier 12 but a remarkable degree of stability exists without its presence.

The foregoing description is submitted as representing the best mode of carrying out this invention but is not intended to be limiting of the scope thereof. Rather the following claims define the invention and their scope plus equivalents are protected thereby.

What is claimed is:

1. A vestlike handgun carrier comprising:

a holster body including a pair of spaced support points, one located in the muzzle and the second in the chamber region of a handgun carried in the holster body;

a first crescent shaped shoulder strap, means securing the opposite ends of said shoulder strap to respective spaced support points of said holster body, a second crescent shaped shoulder strap, means connecting the ends of said second crescent shaped shoulder strap in the opposite underarm region of the wearer, first broad area elastic means joining said first and second crescent shaped shoulder straps across the rear of the shoulders of the wearer below his collar, second broad area elastic means joining said first and second crescent shaped shoulder straps across the back of the wearer, said first and second joining means constituting the interconnection between said first and second crescent shaped shoulder straps;

said first and second crescent shaped shoulder straps and said first and second joining means defining a quadrilateral support structure for the holster capable of limited distortion with movement of the wearer while maintaining the holster and handgun therein in relatively stable position under the wearer's arm.

2. The combination in accordance with claim 1 wherein said connecting means comprises an ammunition carrier.

3. The combination in accordance with claim 2 wherein said ammunition carrier has a generally "Y" shape with means securing the arms of said "Y" to opposite ends of said first shoulder strap.

4. The combination in accordance with claim 3 wherein said ammunition carrier inlcudes belt means secured to the leg of the "Y" at the lower end of said ammunition carrier to the belt of the wearer.

5. The combination in accordance with claim 1 wherein said first and second broad area elastic means is at least one inch in width to produce broad area contact with the wearer's back.

* * * * *